US006659764B2

(12) United States Patent
Xu

(10) Patent No.: US 6,659,764 B2
(45) Date of Patent: Dec. 9, 2003

(54) PALM ACTUATION LIGHTER

(75) Inventor: Wen Xu, Zhejiang (CH)

(73) Assignee: Zreative Products Inc., El Monte, CA (US)

( * ) Notice: Subject to any disclaimer, the term of this patent is extended or adjusted under 35 U.S.C. 154(b) by 0 days.

(21) Appl. No.: 10/195,158

(22) Filed: Jul. 16, 2002

(65) Prior Publication Data

US 2002/0197576 A1 Dec. 26, 2002

(51) Int. Cl.[7] ..... F23Q 2/28
(52) U.S. Cl. ..... 431/153; 431/255; 431/125
(58) Field of Search ..... 431/126, 255, 431/344, 153, 132, 144, 152, 125, 142, 253

(56) References Cited

U.S. PATENT DOCUMENTS 5,460,520 A * 10/1995 Lin ..... 431/255
5,865,614 A * 2/1999 Hsu ..... 431/255
6,267,582 B1 * 7/2001 Lin ..... 431/255

FOREIGN PATENT DOCUMENTS

EP 0347383 * 12/1989 ..... 431/255
JP 2000-55362 * 2/2000 ..... 431/255

* cited by examiner

*Primary Examiner*—James C. Yeung
(74) *Attorney, Agent, or Firm*—Raymond Y. Chan; David and Raymond Patent Group

(57) ABSTRACT

A palm actuation lighter includes two elongated actuation arms having two opposed outer side gripping surfaces respectively wherein a piezoelectric unit is positioned between the side gripping surfaces. The actuation arms are arranged to compress the piezoelectric unit by a compression force applied on the side gripping surfaces so as to ignite the palm actuation lighter. Therefore, the actuation arms function as a physical barrier to prevent a hand of a child from compressing the piezoelectric unit while an adult is able to compress the actuation arms by using at least two fingers and a thumb of the adult on the side gripping surfaces respectively so as to ignite the palm actuation lighter.

8 Claims, 7 Drawing Sheets

PALM ACTUATION LIGHTER

BACKGROUND OF THE PRESENT INVENTION

1. Field of Invention

The present invention relates to a lighter, and more particularly to a palm actuation lighter, wherein a user must apply a compressing force on two actuation arms to ignite the palm actuation lighter, such that the physical barrier of the ignition operation can prevent the palm actuation lighter from being ignited accidentally or by children.

2. Description of Related Arts

Utility lighters, such as piezoelectric lighters or barbecue lighters, have been known and sold throughout the world. The advantage of such utility lighters is economy, cheap, and easy operation.

A conventional utility lighter comprises an ignition button which is positioned on a lighter casing and operatively arranged to be depressed for igniting the utility lighter. However, the operationally structure of the utility lighter creates a repercussion that the utility lighter may cause undesirable ignition, especially by children.

Due to the safety purpose, both the government and the consumers in United States demand a safety device employed in every lighter to prevent unwanted ignition accidentally or by a child. Most of the utility lighters are employed with a safety lock that normally locks up a depression of the ignition button so as to prevent the utility lighter from unwanted ignition. However, the structure of such safety lock is more complicated that highly increases the manufacturing cost of the utility lighter. Furthermore, most of the children are smart enough figure out how to unlock the safety lock in order to ignite the utility lighter.

Besides, since the design of the ignition button is conventionally constructed on the lighter casing, the appearance of the utility lighter will be restrictively limited by the ignition button in such a manner that the push-down type ignition button prevents the industry designers to create any ornament design.

SUMMARY OF THE PRESENT INVENTION

A main object of the present invention is to provide a palm actuation lighter, which comprises an actuation arm pivotally mounted to a lighter body, wherein an adult must apply a compressing force on the actuation arm to pivotally move the actuation arm towards the lighter body for ignition, such that the actuation arm forms as a physical barrier for preventing the palm actuation lighter from being ignited accidentally or by children.

Another object of the present invention is to provide a palm actuation lighter, wherein the adult must use his or her fingers and thumb to apply the compressing force on the lighter body and the actuation arm respectively, so that the children are unable to physically ignite of palm actuation lighter.

Another object of the present invention is to provide a palm actuation lighter, which can be designed and crafted to a variety of shapes and models without affecting the operation of the lighter, so as to enhance the aesthetic appearance of the palm actuation lighter.

Another object of the present invention is to provide a palm actuation lighter, wherein the ignition of the palm actuation lighter of the present invention merely requires a simple single-action operation by the adult instead of the conventional double-action operation.

Another object of the present invention is to provide a palm actuation lighter, wherein the mechanical design of the palm actuation lighter is fitted to employ in a conventional piezoelectric lighter and the barbecue lighter without altering the original structure of the present invention.

Another object of the present invention is to provide a palm actuation lighter, wherein no expensive or complicated mechanism is required to employ in the palm actuation lighter, so as to minimize the manufacturing cost of the palm actuation lighter of the present invention.

Accordingly, in order to accomplish the above objects, the present invention provides a palm actuation lighter, which comprises:

- a lighter body receiving a fuel storage and having an ignition cavity provided therein;
- an ignition system, which comprises:
  - a gas emitting nozzle communicating with the fuel storage for controlling a flow of gaseous fuel; and
  - a piezoelectric unit disposed in the ignition cavity, wherein the piezoelectric unit comprises a main piezoelectric body, a movable operating part slidably extended therefrom, and a spark generating tip extended to a position close to the gas emitting nozzle, wherein when the movable operating part is depressed with respect to the main piezoelectric body, the spark generating tip generates sparks to ignite the gaseous fuel emitted from the gas emitting nozzle; and
- two elongated actuation arms having two opposed outer side gripping surfaces respectively while the lighter body is positioned between the side gripping surfaces, wherein the actuation arms are arranged to compress the piezoelectric unit by a compression force applied on the side gripping surfaces so as to ignite the palm actuation lighter, thereby the actuation arms function as a physical barrier to prevent a hand of a child from compressing the piezoelectric unit while an adult is able to compress the actuation arms by using at least two fingers and a thumb of the adult on the side gripping surfaces respectively so as to ignite the palm actuation lighter.

DETAILED DESCRIPTION OF THE PREFERRED EMBODIMENT

Figure 1:
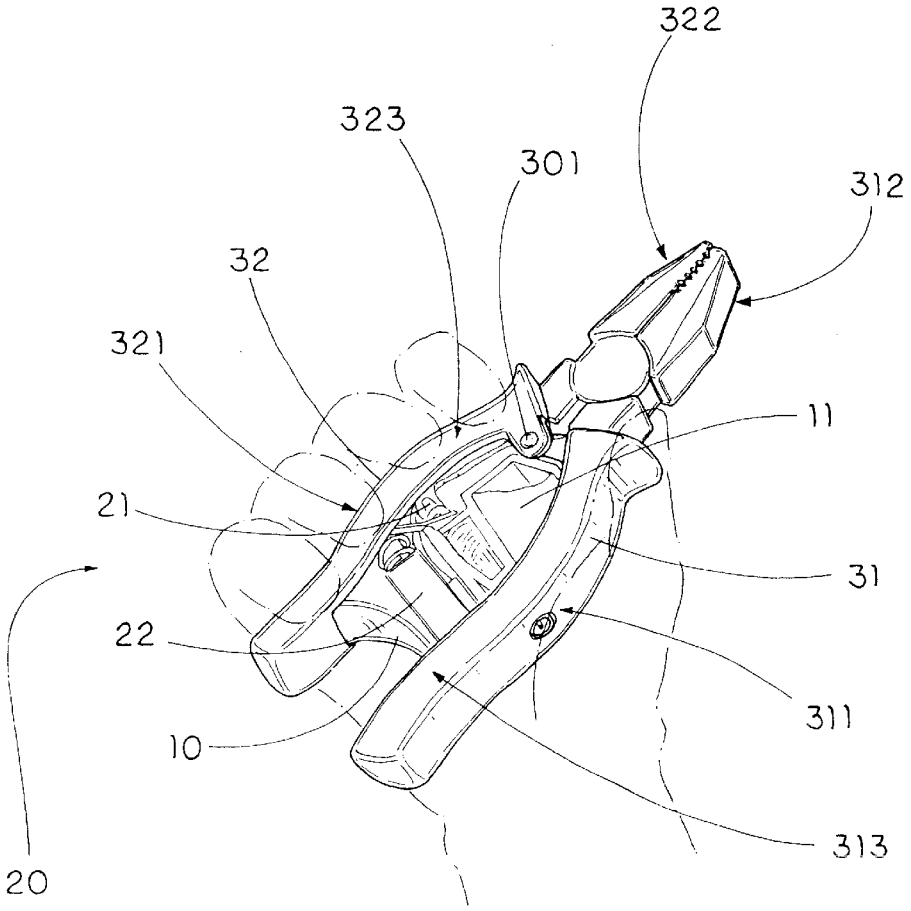
FIG. 1 is a perspective view of a palm actuation lighter according to a first preferred embodiment of the present invention.
Figure 2:
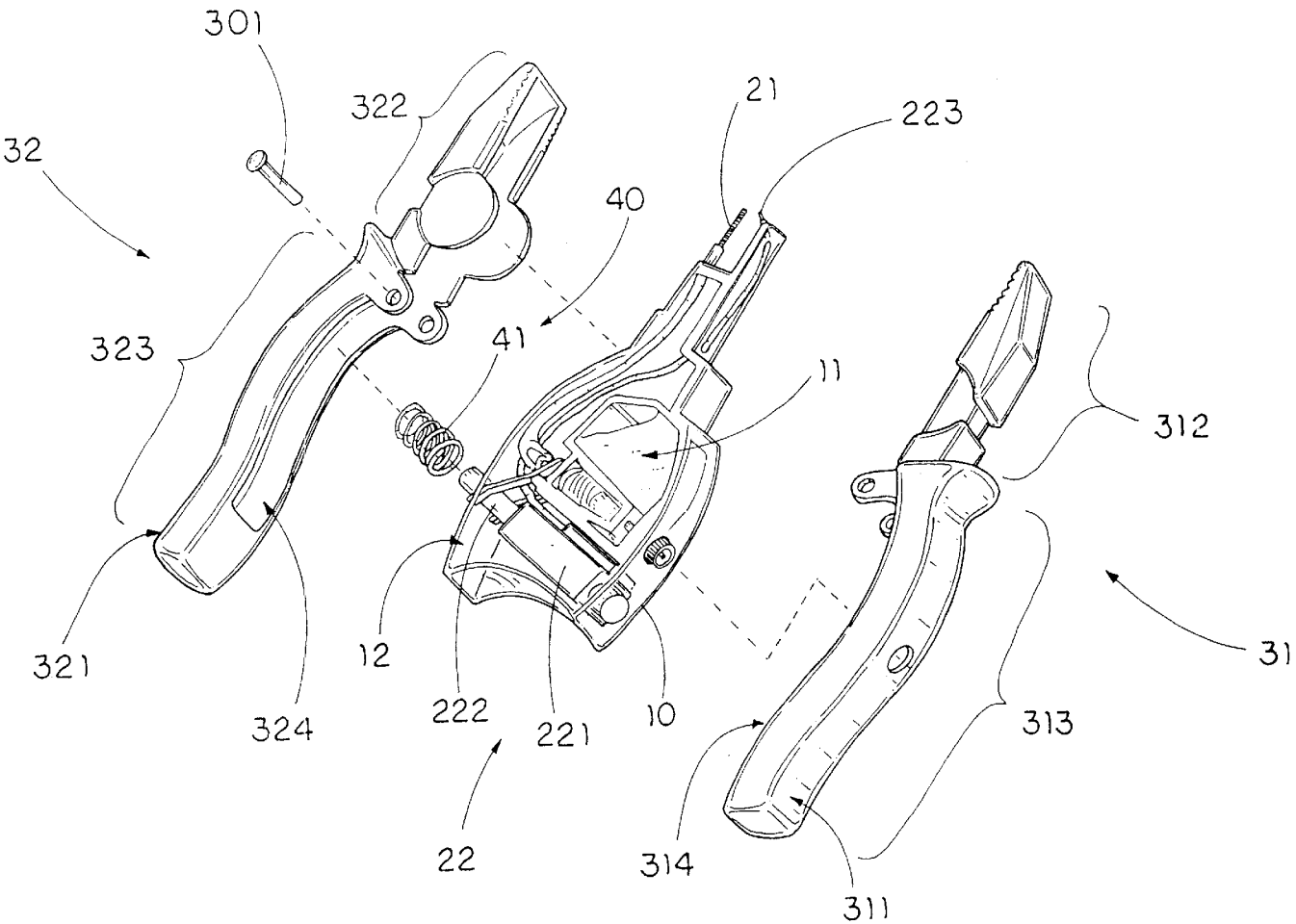
FIG. 2 is an exploded perspective view of the palm actuation lighter according to the above first preferred embodiment of the present invention.

Referring to FIGS. 1 and 2 of the drawings, a palm actuation lighter according to a first preferred embodiment of the present invention is illustrated, wherein the palm actuation lighter comprises a lighter body 10 receiving a fuel storage 11 and having an ignition cavity 12 provided therein, an ignition system 20, and two actuation arms 31, 32.

The ignition system 20 comprises a gas emitting nozzle 21 communicating with the fuel storage 11 for controlling a flow of gaseous fuel and a piezoelectric unit 22 disposed in the ignition cavity 12 wherein the piezoelectric unit 22 comprises a main piezoelectric body 221, a movable operating part 222 slidably extended therefrom, and a spark generating tip 223 extended to a position close to the gas emitting nozzle 21 in such a manner that when the movable operating part 222 is depressed with respect to the main piezoelectric body 221, the spark generating tip 223 generates sparks to ignite the gaseous fuel emitted from the gas emitting nozzle 21.

The two elongated actuation arms 31, 32 have two opposed outer side gripping surfaces 311, 321 respectively wherein the lighter body 10 is positioned between the side gripping surfaces 311, 321. The actuation arms 31, 32 are arranged to compress the piezoelectric unit 22 by a compression force applied on the side gripping surfaces 311, 321 so as to ignite the palm actuation lighter. Therefore, the actuation arms 31, 32 function as a physical barrier to prevent a hand of a child from compressing the piezoelectric unit 22 while an adult is able to compress the actuation arms 31, 32 by using at least two fingers and a thumb of the adult on the side gripping surfaces 311, 321 respectively so as to ignite the palm actuation lighter.

According to the preferred embodiment, the palm actuation lighter is shaped as a pair of pliers, wherein the two actuation arms 31, 32 are pivotally connected with each other about a pivot joint 301 in such a manner that the lighter body 10 is mounted between the two actuation arms 31, 32. As shown in FIG. 1, each of the actuation arms 31, 32 has a head covering portion 312, 322 defining above the pivot joint 301 to enclose the gas emitting nozzle 21 and a handle portion 313, 323 forming below the pivot joint 301 wherein the side gripping surfaces 311, 321 are provided on two outer sides of the handle portions 313, 323 of the actuation arms 31, 32 respectively.

Accordingly, the gas emitting nozzle 21 is enclosed by the head covering portions 312, 322 of the actuation arms 31, 32 at a normal position and the lighter body 10 is mounted between the handle portions 313, 323 of the actuation arms 31, 32 in such a manner that when the compression force is applied on the side gripping surfaces 311, 321 of the actuation arms 31, 32, the piezoelectric unit 22 is compressed to ignite the palm actuation lighter while the head covering portions 312, 322 of the actuation arms 31, 32 are pivotally moved at a position that the gas emitting nozzle 21 is exposed to outside. In other words, the gas emitting nozzle 21 is normally enclosed by the head covering portions 312, 322 of the actuation arms 31, 32, so as to protect the gas emitting nozzle 21 from being damaged.

Figure 3A:
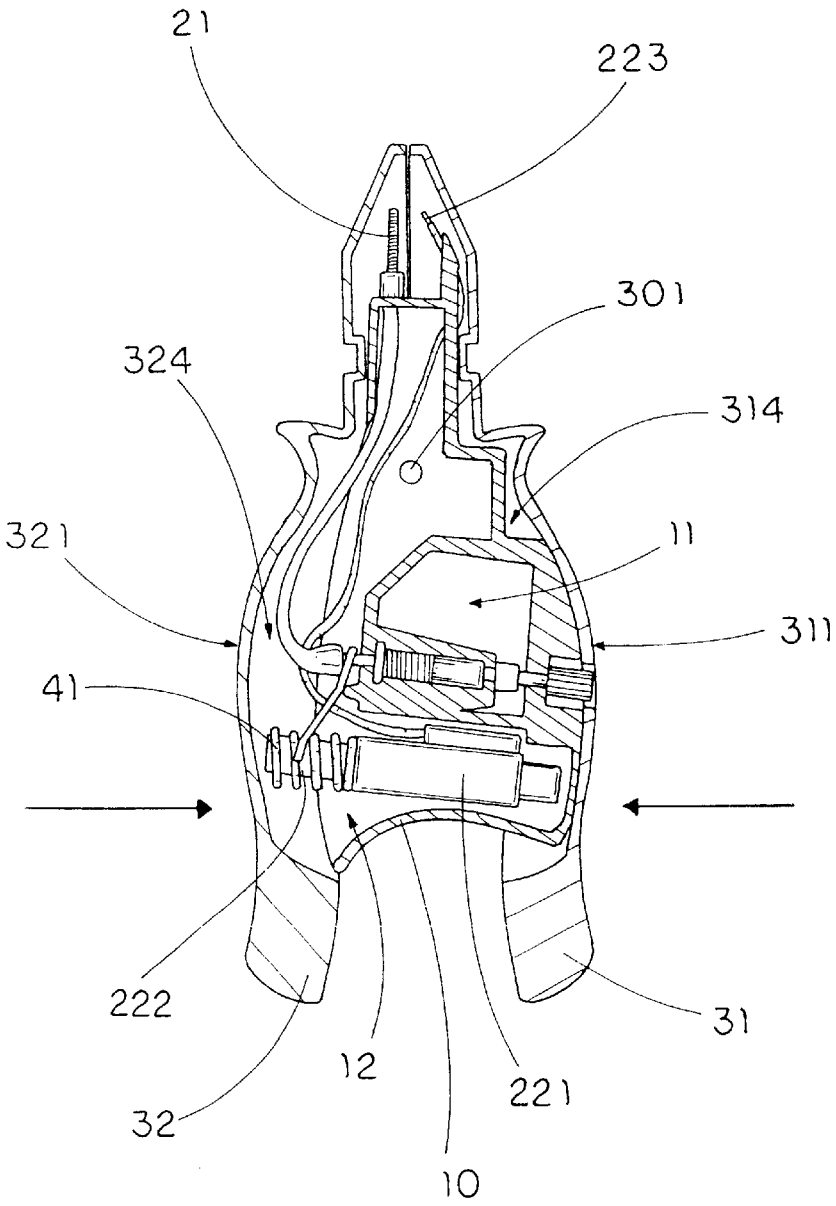
FIG. 3A is a sectional view of the palm actuation lighter according to the above first preferred embodiment of the present invention.
Figure 3B:
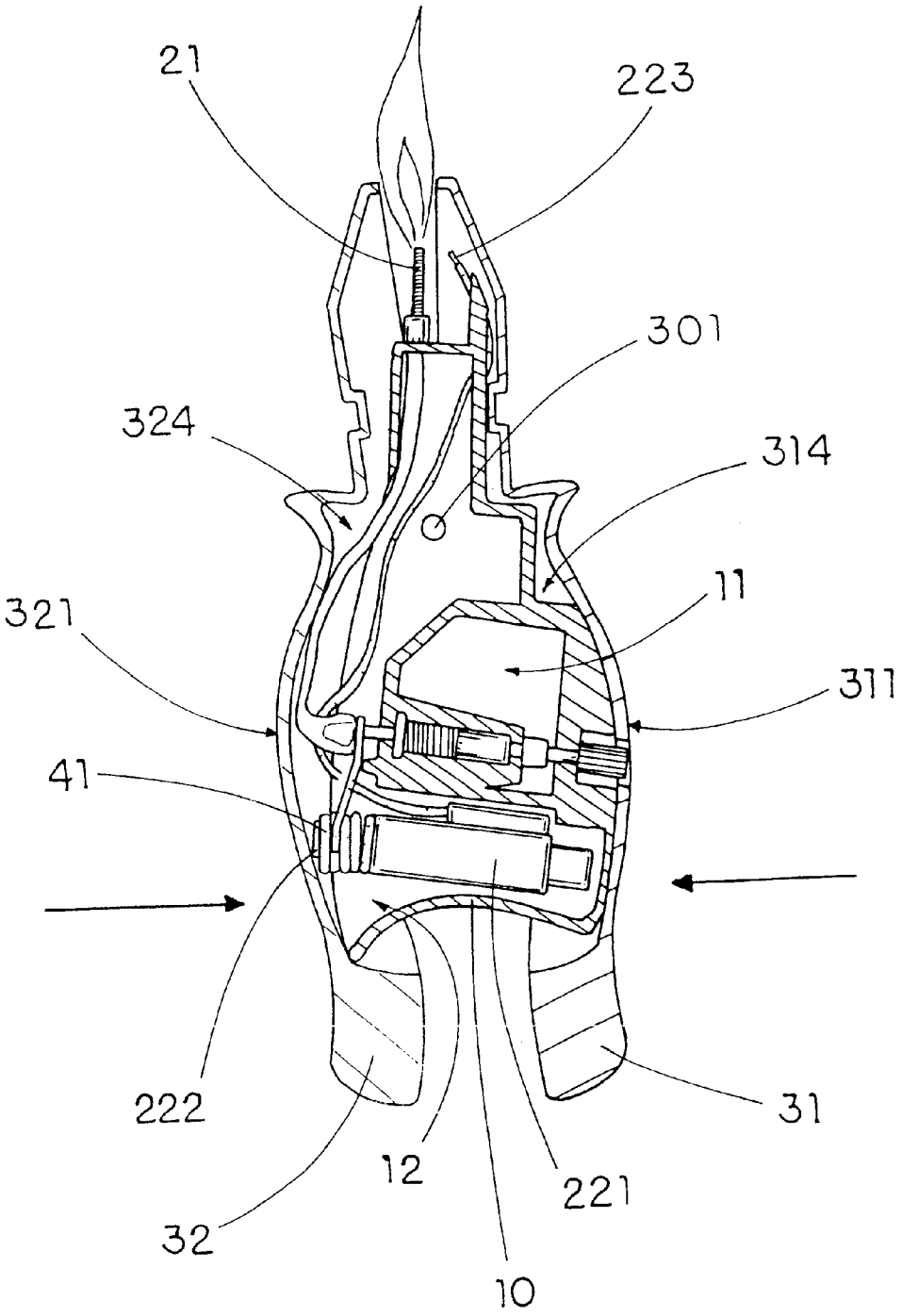
FIG. 3B is a sectional view of the palm actuation lighter in an ignition position according to the above first preferred embodiment of the present invention.

As shown in FIG. 3A, the piezoelectric unit 22 is transversely positioned between the actuation arms 31, 32 wherein a bottom end of the piezoelectric main body 221 is biased against one of the actuation arms 31 while a top end of the movable operating part 222 of the piezoelectric unit 22 is adapted to bias against another actuation arms 32 such that the piezoelectric unit 22 is arranged to be compressed by the pivotal movements of the actuation arms 31, 32. Moreover, the piezoelectric unit 22 provides a press resistance force that resists the compression force applied by an under age child on the actuation arms 31, 32 while the adult is capable of pressing the actuation arms 31, 32 to compress the piezoelectric unit 22 so as to ignite the palm actuation lighter, as shown in FIG. 3B.

For enhancing the press resistance of the palm actuation lighter, the piezoelectric unit 22 is inclinedly supported between the actuation arms 31, 32 such that a greater compression force must be applied on the actuation arms 31, 32 in order to compress the piezoelectric unit 22. Accordingly, the piezoelectric unit 22 is inclinedly supported between the actuation arms 31, 32 to adjust the press resistance force of the piezoelectric unit 22. When the piezoelectric unit 22 is positioned perpendicularly between the actuation arms 31, 32, the compression force must be equal to the press resistance force. However, when the piezoelectric unit 22 is positioned inclinedly, the adult may require less compression force to compress the actuation arms 31, 32. Therefore, the press resistance force of the piezoelectric unit 22 can be selectively adjusted by the transverse position between the actuation arms 31, 32. Moreover, the inclined position of the piezoelectric unit 22 can reduce a distance between the actuation arms 31, 32 so as to minimize the size of the palm actuation lighter.

In order to mount the lighter body 10 between the actuation arms 31, 32 in position, each of the actuation arms 31, 32 has an elongated guiding slot 314, 324 provided at an inner side thereof, wherein two side portions of the lighter body 10 are received in the guiding slots 314, 324 of the actuation arms 31, 32 respectively.

Accordingly, one of the side portions of the lighter body 10 is securely attached to the respective actuation arm 31 within the guiding slot 314 while another side portion of the lighter body 10 is movably disposed in the guiding slot 324 of another actuation arm 32 in such a manner that by compressing the actuation arms 31, 32, two ends of the piezoelectric unit 22 is guided to be compressed by two inner walls of the guiding slots 314, 324 of the actuation arms 31, 32 respectively.

As shown in FIGS. 2 and 3A, the palm actuation lighter further comprises means 40 for providing an additional press resistance force so as to resist the compression force applied on the actuation arms 31, 32. The resistance means 40 comprises a deformable resistance element 41 supported in the ignition cavity 12 to resist the compression force. The deformable resistance element 41, according to the preferred embodiment, is a compression spring, coaxially mounted on the movable operating part 222 of the piezoelectric unit 22 and placed between a ceiling of the main piezoelectric body 221 and the inner wall of the guiding slot 324 of the respective actuation arm 32, in such a manner that the compression force applied on the actuation arms 31, 32 must overcome not only the press resistance force of the piezoelectric unit 22 but also the additional press resistance force of the deformable resistance element 41, so as to compress the piezoelectric unit 22 for ignition.

It is worth mentioning that the deformable resistance element 41 can be a rubber post mounted between the top end of the piezoelectric unit 22 and the inner wall of the guiding slot 324 of the respective actuation arm 32, so that the deformable resistance element 41 can provide the additional press resistance force for stopping the under age children from the usage of the palm actuation lighter by the limitation of their physical capability.

In order to ignite the palm actuation lighter, the adult must use at least two fingers and a thumb thereof to hold and compress the actuation arms 31, 32 at the side gripping surfaces 311, 321 thereof respectively to compress the piezoelectric unit 22, as shown in FIG. 3B. However, the under age child, having a smaller hand's size, do not have enough physical strength to apply the compression force of the actuation arms 31, 32, especially when the deformable resistance element 410 is employed in the lighter body 10.

By releasing the compression force on the actuation arms 31, 32, the compressed piezoelectric unit 22 is rebounded and the deformable resistance element 41 is restored to regain its original form so as to pivotally push the actuation arms 31, 32 returning back to the normal position instantly.

Figure 4:
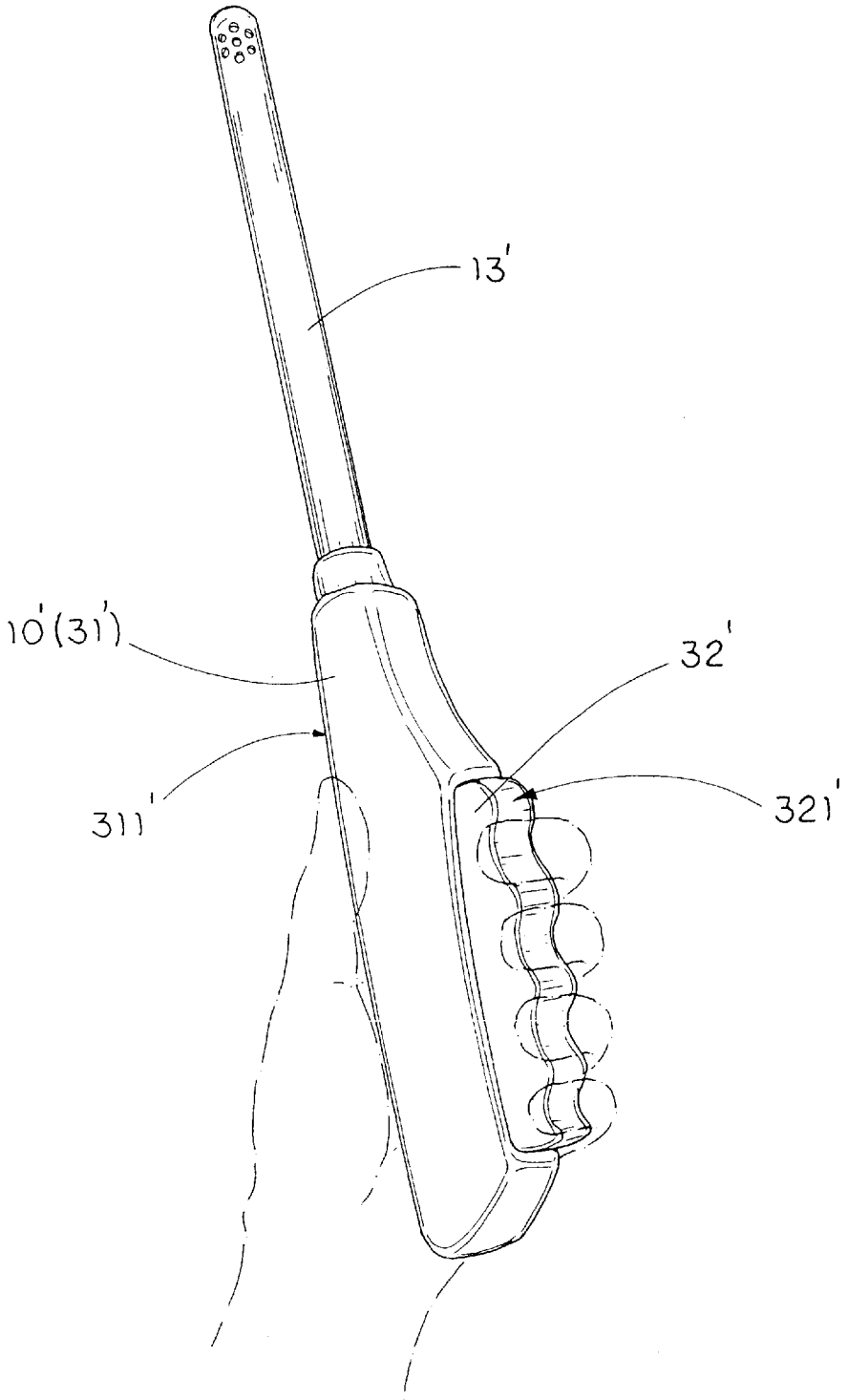
FIG. 4 is a perspective view of a palm actuation lighter according to a second preferred embodiment of the present invention.
Figure 5:
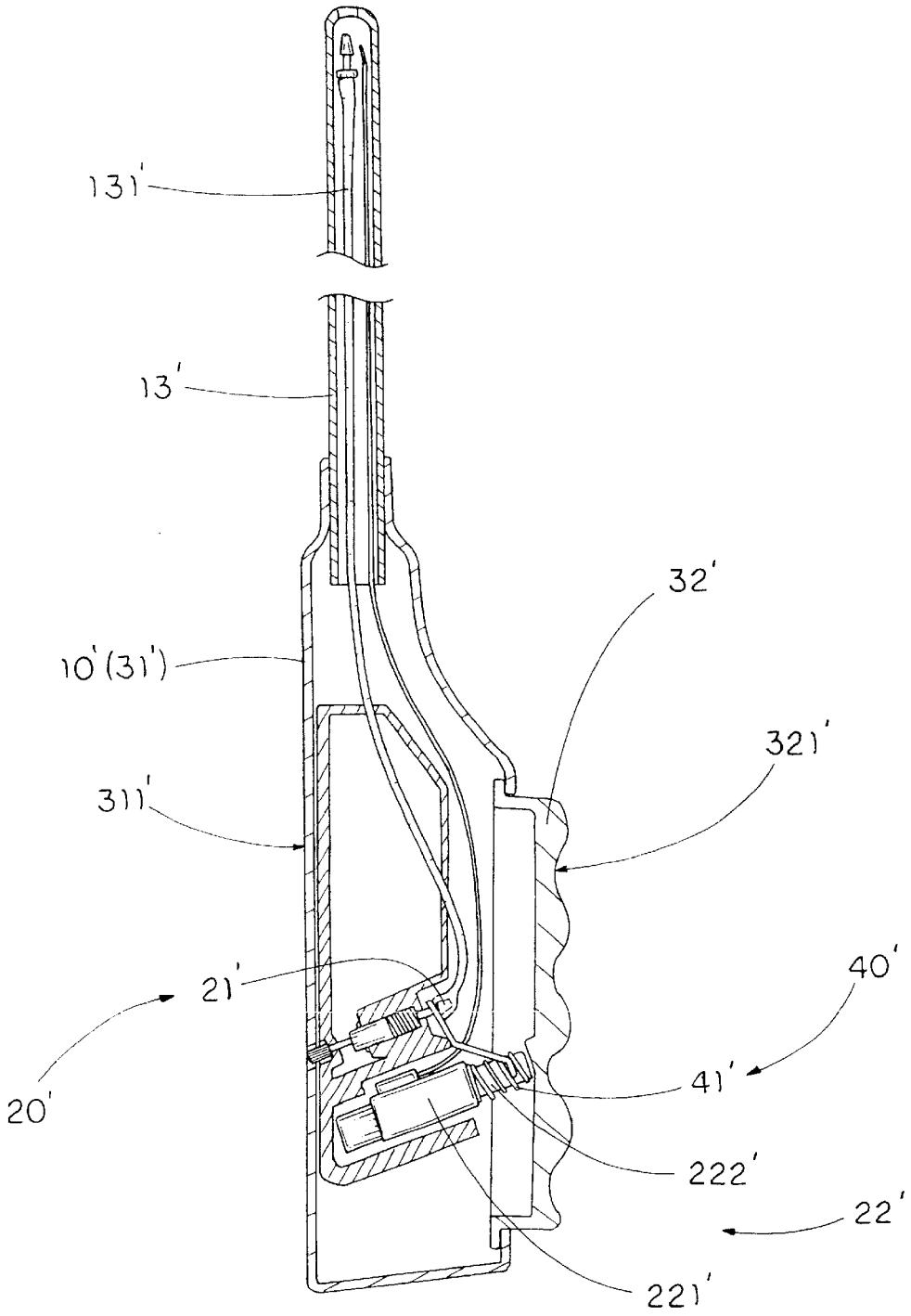
FIG. 5 is a sectional view of the palm actuation lighter according to the above second preferred embodiment of the present invention.

As shown in FIGS. 4 and 5, a palm actuation lighter of a second embodiment illustrates an alternative of the first embodiment of the present invention, wherein the palm actuation lighter is embodied as a barbecue lighter.

According to the second embodiment, the palm actuation lighter further comprises an elongated nozzle tube 13' extended from the lighter body 10' and contains a gas tube 131' therein, wherein the gas tube 131' is extended from the gas emitting nozzle 21' to a distil end of the elongated nozzle tube 13' to form an ignition tip.

As shown in FIG. 5, one of the actuation arms 31' is constructed as the lighter body 10' to receive the ignition system 20' therein while another actuation arm 32' is attached to the lighter body 10' (31') in a sideward movable manner wherein the side gripping surfaces 311', 321' are provided on an outer side of the lighter body 10'(31') and an outer side of the actuation arm 32' respectively, such that when the compression force is applied on the actuation arm 32' and the lighter body 10'(31'), the piezoelectric unit 22' is compressed to ignite the palm actuation lighter.

The piezoelectric unit 22' is inclinedly supported between the inner wall of the actuation arm 32' and the inner side of the lighter body 10'(31') to provide a press resistance force therebetween, so as to ensure the safety function of the palm actuation lighter.

The palm actuation lighter further comprises means 40' for providing an additional press resistance force so as to resist the compression force applied on the lighter body 10'(31') and the actuation arm 32', wherein the resistance means 40' comprises a deformable resistance element 41' which is supported in the ignition cavity 12', coaxially mounted on the movable operating part 222' of the piezoelectric unit 22' and placed between a ceiling of the main piezoelectric body 221' and the inner wall of the actuation arm 32', in such a manner that the compression force must overcome not only the press resistance force of the piezoelectric unit 22' but also the additional press resistance force of the deformable resistance element 41', so as to compress the piezoelectric unit 22' for ignition.

Figure 6:
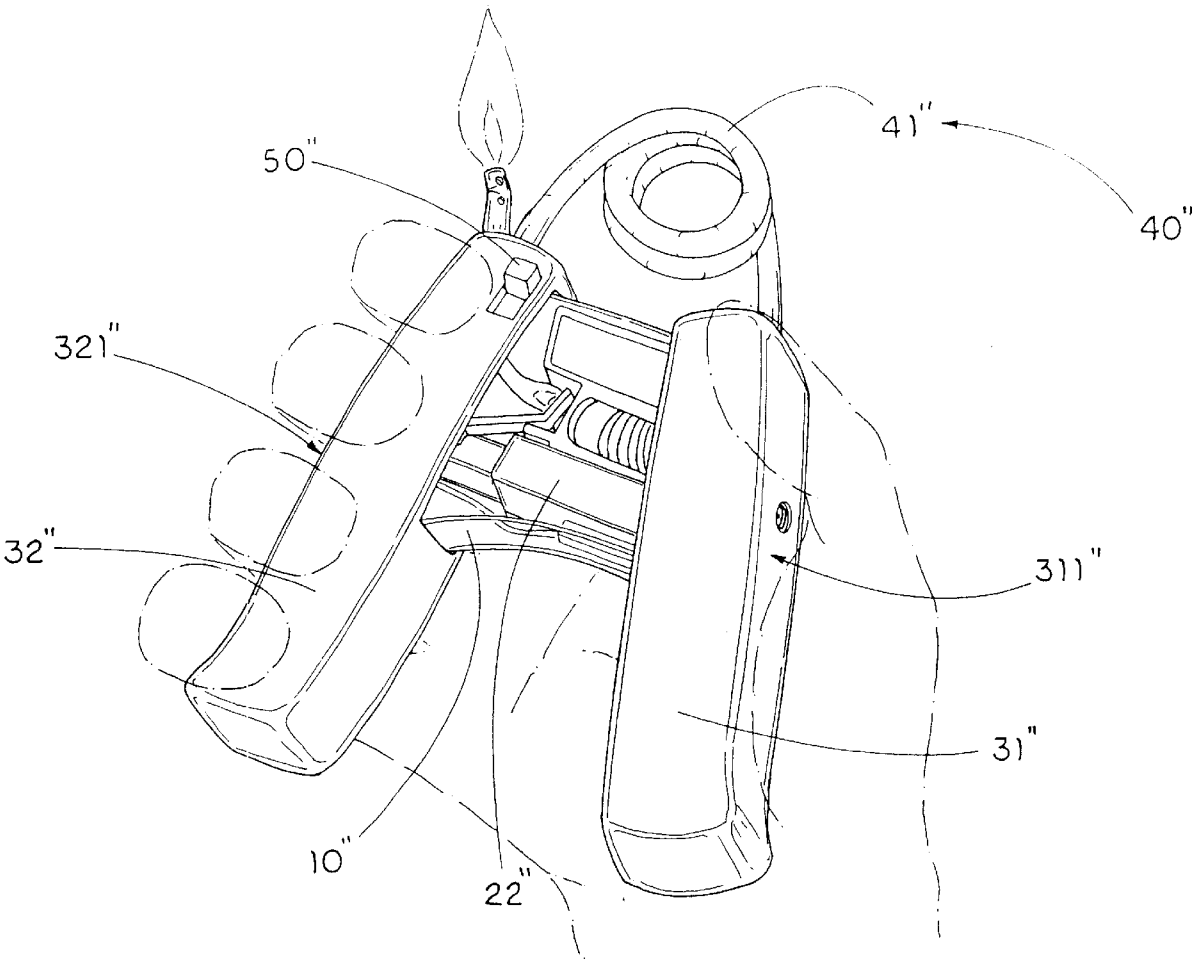
FIG. 6 is a perspective view of a palm actuation lighter according to a third preferred embodiment of the present invention.

As shown in FIG. 6, a palm actuation lighter of a third embodiment illustrates another alternative of the first embodiment, wherein the palm actuation lighter of the third embodiment is constructed as a vice grip.

Accordingly, the lighter body 10" is mounted between the actuation arms 31", 32" wherein the piezoelectric unit 22" is inclinedly supported therebetween, in such a manner that when the compression force is applied on side gripping surfaces 311", 321" of the actuation arms 31", 32", the piezoelectric unit 22" is compressed to ignite the palm actuation lighter.

The palm actuation lighter further comprises means 40" for providing an additional press resistance force so as to resist the compression force applied on the actuation arms 31", 32". The resistance means 40" comprises a deformable resistance element 41" mounted between the two actuation arms 31", 32".

As shown in FIG. 6, the deformable resistance element 41" is a coiled spring having two ends substantially attached to the actuation arms 31", 32" respectively in such a manner that the palm actuation lighter is shaped as the vice grip. Therefore, the under age children are impossible to ignite the palm actuation lighter by limiting their physical strength.

Moreover, the palm actuation lighter further comprises an ignition switch 50" provided on one of the actuation arms 31", 32" for selectively switching the ignition system 20" in an on and off manner. Therefore, when the ignition system 20" is switched off by the ignition switch 50", the palm actuation lighter functions as a vice grip for providing a hand strength exercise to the adult. Once the ignition system 20" is switched on by the ignition switch 50", the adult is able to use his or her fingers and thumb to grip on the side gripping surfaces 311", 321" of the actuation arms 31", 32" respectively to compress the actuation arms 31", 32" so as to compress the piezoelectric unit 22" for ignition.

Without violating the very spirit of present invention, some variations based on the above mentioned embodiments should be considered as equivalence. For example, the palm actuation lighter can be shaped into any aesthetic appearance wherein the ignition operation thereof requires at least two fingers and a thumb of the adult to compress the actuation arms. Therefore, the palm actuation lighter can be constructed to any desirable shape to minimize the under age child's attention from the non-lighter-liked shape of the present invention and to enhance the aesthetic appearance thereof. Thus, the present invention can stop the under age children from the usage of the palm actuation lighter by the limitation of their physical capability.

What is claimed is:

1. A palm actuation lighter, comprising:

a lighter body receiving a fuel storage and having an ignition cavity provided therein;

an ignition system, which comprises:

a gas emitting nozzle communicating with said fuel storage for controlling a flow of gaseous fuel; and a piezoelectric unit disposed in said ignition cavity, wherein said piezoelectric unit comprises a main piezoelectric body, a movable operating part slidably extended therefrom, and a spark generating tip extended to a position close to said gas emitting nozzle, wherein when said movable operating part is depressed with respect to said main piezoelectric body, said spark generating tip generates sparks to ignite said gaseous fuel emitted from said gas emitting nozzle; and two elongated actuation arms having two opposed outer side gripping surfaces respectively while said lighter body is positioned between said side gripping surfaces, wherein said actuation arms are arranged to compress said piezoelectric unit by a compression force applied on said side gripping surfaces so as to ignite said palm actuation lighter, thereby said actuation arms function as a physical barrier to prevent a hand of a child from compressing said piezoelectric unit while an adult is able to compress said actuation arms by using at least two fingers and a thumb of said adult on said side gripping surfaces respectively so as to ignite said palm actuation lighter; wherein said two actuation arms are pivotally connected with each other by a pivot joint, wherein each of said actuation arms has an elongated guiding slot provided at an inner side thereof such that two side portions of said lighter body are mounted in said guiding slots of said actuation arms respectively.

2. A palm actuation lighter, as recited in claim 1, wherein each of said actuation arms has a head covering portion defining above said pivot joint to enclose said gas emitting nozzle and a handle portion defining below said pivot joint, wherein said side gripping surfaces are provided on two outer sides of said handle portions of said actuation arms respectively and said guiding slots are provided on two inner sides of said handle portions of said actuation arms respectively in such a manner that when said compression force is applied on said handle portions of said actuation arms, said head covering portions of said actuation arms are pivotally moved at a position that said gas emitting nozzle is exposed to outside.

3. A palm actuation lighter, as recited in claim 2, wherein said piezoelectric unit is inclinedly supported between said actuation arms so as to provide a press resistance force for biasing against said compression force applied on said actuation arms.

4. A palm actuation lighter, as recited in claim 3, further comprising means for providing an additional press resistance force to resist said compression force applied on said actuation arms.

5. A palm actuation lighter, as recited in claim 4, wherein said resistance means comprises a deformable resistance element coaxially mounted on said movable operating part of said piezoelectric unit and placed between a ceiling of said main piezoelectric body and an inner wall of said respective actuation arm, so as to provide said additional press resistance force to resist said compression force applied on said actuation arms.

6. A palm actuation lighter, as recited in claim 2, further comprising means for providing an additional press resistance force to resist said compression force applied on said actuation arms.

7. A palm actuation lighter, as recited in claim 6, wherein said resistance means comprises a deformable resistance element coaxially mounted on said movable operating part of said piezoelectric unit and placed between a ceiling of said main piezoelectric body and an inner wall of said respective actuation arm, so as to provide said additional press resistance force to resist said compression force applied on said actuation arms.

8. A palm actuation lighter, as recited in claim 1, wherein said piezoelectric unit is inclinedly supported between said actuation arms so as to provide a press resistance force for biasing against said compression force applied on said actuation arms.

* * * * *